US006059040A

United States Patent [19]

Levitan et al.

[11] Patent Number: 6,059,040

[45] Date of Patent: May 9, 2000

[54] METHOD AND APPARATUS FOR WITHDRAWAL OF LIQUID PHASE FROM WELLBORES

[76] Inventors: Leonid L. Levitan, 1770 W. 6th St., Apt. B5, Brooklyn, N.Y. 11223; Vasily V. Salygin, 1 Central Park W., Apt. 3D, New York, N.Y. 11023; Vladimir D. Yurchenko, 20 Van Sicklen St., Apt. 2-Ft., Brooklyn, N.Y. 11223

[21] Appl. No.: 08/933,628

[22] Filed: Sep. 19, 1997

[51] Int. Cl.[7] ..... E21B 43/00

[52] U.S. Cl. ..... 166/372; 166/68

[58] Field of Search ..... 166/372, 369, 166/373, 370, 68, 105

[56] References Cited

U.S. PATENT DOCUMENTS

| | | | |
|---|---|---|---|
| 4,390,061 | 6/1983 | Short . | |
| 4,509,599 | 4/1985 | Chenoveth et al. . | |
| 4,678,040 | 7/1987 | McLaughlin et al. . | |
| 4,791,990 | 12/1988 | Amani . | |
| 5,006,046 | 4/1991 | Buckman et al. . | |
| 5,105,889 | 4/1992 | Misikov et al. . | |
| 5,302,286 | 4/1994 | Semprini et al. . | |
| 5,374,163 | 12/1994 | Jaikaran . | |
| 5,407,010 | 4/1995 | Herschberger . | |
| 5,547,021 | 8/1996 | Raden . | |
| 5,562,161 | 10/1996 | Hisaw et al. . | |
| 5,707,214 | 1/1998 | Schmidt | 166/372 X |
| 5,785,124 | 7/1998 | Hisaw et al. | 166/372 |
| 5,806,599 | 9/1998 | Hisaw et al. | 166/372 |

OTHER PUBLICATIONS

*Gas Dynamics of Two–Phase Flows*, M. Deich, G. Phillippov, Energy Publishing House, Moscow, 1968, pp. 206–292.

*Production, Treatment and Transportation of Natural Gas and Condensate* vol. 1, Y. Korotayev et al., Neda Publishing House, Moscow, 1984, pp. 179–189, 337–355.

*Two–Phase Flow in Pipelines and Heat Exchangers*, D. Chisholm, 1983, pp. 133–196.

Chap. 9–2, The Adiabatic Flow of the Self Evaporated Liquid, pp. 246–254, and the English translation.

*Primary Examiner*—Frank Tsay

*Attorney, Agent, or Firm*—Collard & Roe, P.C.

[57] ABSTRACT

A method is for increasing the production of a hydrocarbon wellbore at its medium and last stage of exploitation, based on removal of the accumulated liquid phase from the bottom of the well. The method includes the installation of a device within the well. The device includes a mandrel and sealing assembly, with the nozzle installed inside the mandrel and above the sealing assembly. Apertures are drilled through the mandrel and the nozzle throat. The device creates the low pressure zone in the tubing of the well and evacuates the liquid phase from the tubing wall and the bottomhole to the gas-liquid upwardly directed flow core.

9 Claims, 3 Drawing Sheets

ΔP1 - dissipated pressure in the nozzle;
ΔP2 - dissipated pressure in the mandrel;
ΔP - total gained pressure for the liquid phase removal

METHOD AND APPARATUS FOR WITHDRAWAL OF LIQUID PHASE FROM WELLBORES

BACKGROUND OF THE INVENTION

1. Field of the Invention

The present invention relates to the production of hydrocarbons, such as gas, condensate and oil, from a subsurface production formation. More particularly, the present invention is effective in a well formation having a lack of pressure,wherein two-phase flow velocity is insufficient to carry upwardly the liquid hydrocarbon phase from the bottom of the well. The device of the invention can be installed into the well without any reconstruction of the well bore. The invention avoids the use of artificial gas injection to promote the production of subsurface liquid hydrocarbons.

2. The Prior Art

In a method for enhancing production from a wellbore, the well exploitation frequently becomes complicated because of the liquid accumulation at the bottomhole. This accumulated liquid is the reason for the pressure drop within the tubing; it causes a decreasing of the well production and can eventually cause the complete shut down of the well. To avoid these mentioned problems, a number of the technological recovery processes have been used. Such recovery methods include three general procedures in this technology.

In the first recovery method, there is the release and removal of the liquid from the well bottom by lifting it to the surface using various pumps. Also, the gas velocity is maintained within the tubing higher than the critical velocity by the diminution of the tube diameter. Plunger lift and different foam creating chemicals may be used. Then the dispersion flow is improved by use of a mechanical treatment or a heat treatment.

In the second recovery method, there is the release and removal of the liquid from the well bottom by pumping from the formation pay zone. Instead the process has a gas or aqueous liquid fluid injection step into the engrossed strata. Increasing the filtration velocity of the accumulated liquid to the engrossed formation will result; and periodical shut down of the well occurs during which the liquid drains back to the formation.

Third, there is the prevention of the liquid hydrocarbon filtration down to the bottomhole which will reduce the well exploitation rate down to a lower production rate. This will result in an insufficient bottomhole pressure, that will prevent the production of the liquid from the well formation. Thus, there will be an absolute or particular isolation of the source of the liquid production from the strata pay zone. To prevent this, a combination of the first and second recovery methods are used.

Despite the above described prior art methods, a need still exists for a device that is not only useful for liquid withdrawal purposes from a well but which also does not permit fluid to accumulate at the bottom of the well.

Attempts have been made in the past to solve these prior art problems, and prior proposals are as follows:

| U.S. Pat. No. | Date | Patentee |
|---|---|---|
| 4,390,061 | 6/1983 | Short |
| 4,509,599 | 4/1985 | Chenoveth et al. |
| 4,678,040 | 7/1987 | McLaughlin et al. |
| 4,791,990 | 12/1988 | Amani |
| 5,006,046 | 4/1991 | Buckman et al. |

-continued

| U.S. Pat. No. | Date | Patentee |
|---|---|---|
| 5,105,889 | 4/1992 | Misikov et al. |
| 5,302,286 | 4/1994 | Semprini et al. |
| 5,374,163 | 12/1994 | Jaikaran |
| 5,407,010 | 4/1995 | Herschberger |
| 5,547,021 | 8/1996 | Raden |
| 5,562,161 | 10/1996 | Hisaw et al. |

Other Publications

*Gas Dynamics of Two-Phase Flows*, M. Deich, G. Phillippov. Energy Publishing House, Moscow, 1968, pp. 206–292.

*Production, Treatment and Transportation of Natural Gas and Condensate*, Volume 1, Y. Korotayev et al., Nedra Publishing House, Moscow, 1984, pp. 179–189, 337–355.

*Two-phase Flow in Pipelines and Heat Exchangers*. D. Chisholm, Lecturer in Thermodynamics and fluid Mechanics, Glasgow College of Technology, George Godwin, London and New York in association with The Institution of Chemical Engineers, 1983, pp. 133–196.

Hisaw et al. uses artificial gas injection, and not a natural flow of gases from within the well.

SUMMARY OF THE INVENTION

It is an object of the present invention to avoid the use of artificial gas injection and to use the natural flow of gases to enhance the production of hydrocarbons from a subsurface wellbore.

It is another object of the present invention to provide a nozzle within a mandrel and to have apertures in both of the nozzle and the mandrel, and create a continuous fluid flow channel between the outer wall of the mandrel and the throat of the nozzle in the mandrel middle section.

It is a further object of the present invention to create a sufficient pressure difference between the outer wall area of the tubing surrounding the inner flow core of a wellbore to provide for the moving of downstream liquid hydrocarbon from the outer wall to the upstream inner flow core, to cause a dispersion of this liquid into small droplets, and for the removal of the dispersion of small droplets to the surface of the well bore.

It is another object of the present invention to provide novel apparatus for two-phase fluid flow acceleration. The accelerating apparatus generally comprises a mandrel within a sealing assembly and a Laval nozzle disposed within the mandrel and being concentric within the mandrel and the tubing of the well bore. When well gas flows upwardly through the nozzle, its velocity increases at the entrance, and achieves the maximum velocity in the nozzle throat and then decreases in velocity at the exit from the nozzle. As a result the lowest flow pressure takes place in the nozzle throat.

It is a further object of the present invention to provide communication between the downwardly directed hydrocarbon liquid phase in the outer tubing wall area and the upwardly directed flow of hydrocarbon gas within the inner nozzle of the inner mandrel. This communication is provided by apertures, drilled simultaneously through the mandrel neck and the nozzle throat to permit the liquid phase to flow from the higher pressure zone within the outer tubing wall to the lower pressure zone within the inner nozzle throat flow core. The apertures are located above the sealing assembly so that the downstream liquid phase located at the outer tubing wall flows through the apertures to the upstream gas-liquid inner flow core. Here, within the nozzle, this liquid phase is dispersed into small droplets, because the upward gas flow in the nozzle throat has the highest velocity, and the lowest pressure. The dispersed liquid droplet phase is carried upwardly by the exiting gas and evacuated from the well, and is not deposited there within the well.

An advantage of the present invention is based upon providing for a low pressure zone inside the well tubing that is created by the natural upward gas flow within the nozzle throat. Thus, there are no requirements for an artificial gas injection. Consequently, no expensive compressor equipment is required.

Another advantage of the present invention is that there are no moving parts inside the device of the invention. It is compact and can be installed within the inner diameter of the tubing structure.

A further embodiment is that the apparatus of the invention may be installed within the well tubing structure and then removed therefrom, without any reconstruction of the well surface and without employing subsurface equipment.

Another embodiment is that the downwardly directed liquid located within the outer tubing wall and the upwardly directed gaseous fluid in the inner core mix within the nozzle throat. Here the hydrocarbon liquid is dispersed into small droplets, and the natural flow energy becomes sufficient to lift these droplets upwardly to the surface, without artificial gas injection.

The use of the Laval nozzle within the method and apparatus of the present invention is described in chapter 9-2 of *The Adiabatic Flow of the Self Evaporated Liquid*, pp. 246–254.

It is another advantage that there is a minimum of flow energy dissipation due to friction within the device both at the inlet and at the outlet of the nozzle within the mandrel of the present invention.

The gas phase contains several gas components such as water vapor, alkanes and alkenes, while the liquid phase contains liquid components such as hydrocarbons and liquid water.

The present invention is directed to a method for increasing hydrocarbon production from a well, said well having a downhole pressure, having a reservoir, having an outlet, comprising the steps of installing an apparatus within a tubing section of the well above a hermetic sealing means within the tubing section; creating a zone of decreased gaseous fluid pressure within said apparatus by increasing an upward velocity of a gaseous fluid upwardly flowing within said apparatus; delivering a downstream hydrocarbon liquid from an outer wall of said tubing section to said upwardly flowing gaseous fluid within said apparatus; dispersing said liquid into small droplets within said apparatus within said zone of decreased gaseous fluid pressure by mixing together said liquid and said upwardly flowing gaseous fluid; lifting said liquid small droplets upwardly to the outlet of said well; whereby decreasing the downhole pressure of said well causes an increasing of an inflow of liquid from the reservoir of said well into and through said apparatus, and out of said well.

The present invention is also directed to an apparatus for increasing hydrocarbon production from a well and said well having a tubing section, comprising the well tubing section containing a mandrel having a lower section, a middle section, and an upper section; said mandrel having an outer wall; said lower section of said mandrel having hermetic sealing means installed inside said well tubing section; said middle section of said mandrel having apertures drilled through a wall of said middle section; a nozzle installed within said middle section with apertures drilled through a wall of said nozzle; said apertures drilled through said mandrel and through said nozzle connecting together an annular space between said well tubing section and said mandrel outer wall, to a throat inside said nozzle; and said apparatus creating a continuous fluid flow channel between the outer wall of the mandrel and the nozzle throat in the mandrel middle section; and an upper section of said mandrel with means for an attaching tool; said upper section having an outlet means through which the increasing hydrocarbon production can exit the well tubing section.

BRIEF DESCRIPTION OF THE DRAWINGS

Other objects and features of the present invention will become apparent from the following detailed description considered in connection with the accompanying drawing which discloses embodiments of the present invention. It should be understood, however, that the drawing is designed for the purpose of illustration only and not as a definition of the limits of the invention.

In the drawing, wherein similar reference characters denote similar elements throughout the several views.

DETAILED DESCRIPTION OF PREFERRED EMBODIMENTS

Figure 1:
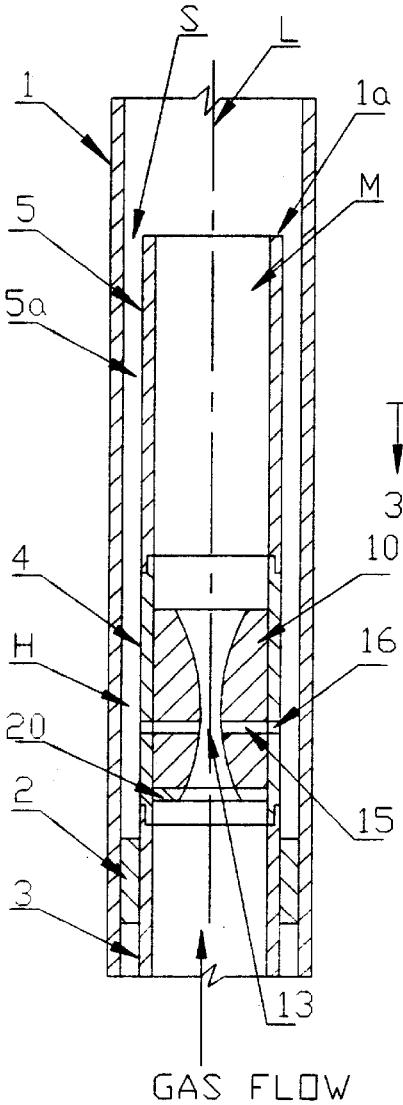
FIG. 1 is a section view of a tubing structure in a well bore with the apparatus of the invention being positioned therein.

Turning now in detail to the drawings, FIG. 1 shows a section of tubing structure 1 with three sections or parts 3, 4, 5 of mandrel M installed inside the tubing structure with nipple sealing means 2. It is important that the mandrel middle section 4 of the invention be located above the nipple hermetic sealing means 2. The FIG. 1 also shows the lowest section part 3 of the mandrel M installed within the tubing and below the nipple or sealing means 2. Sealing means 2 does not allow the liquid phase flow down through the annular space S between inner diameter of the tubing 1 and outer wall 5*a* of the mandrel M. The middle section or part 4 of the mandrel has the Laval nozzle 10 inside. The upper section 5 has a top lip 1*a* of the mandrel M and enables the placement of the nozzle therein, and the withdrawal of the nozzle therefrom. Also, the upper section 5 has outlet opening surrounded by the top lip la through which the increasing hydrocarbon production can exit the well tubing section.

Figure 2:
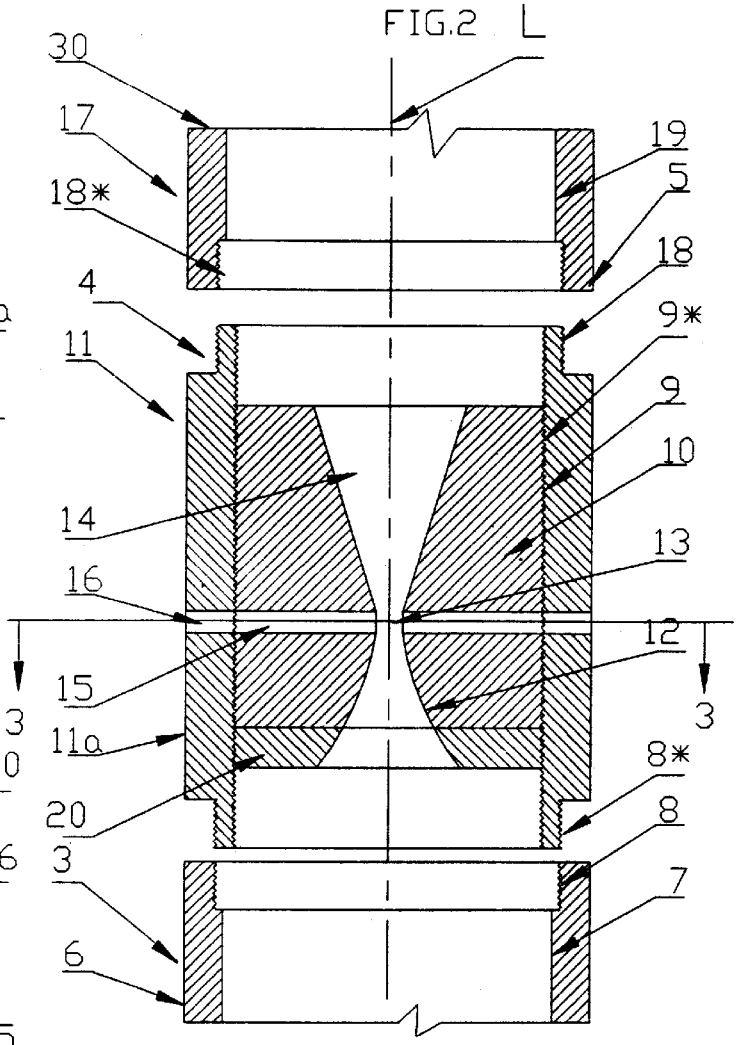
FIG. 2 is a partial exploded sectional view of an apparatus of the invention with a nozzle being positioned therein.

FIG. 2 shows a partial exploded sectional view of the mandrel lower part 3, the mandrel middle part 4, and a portion of the mandrel upper part 5. The mandrel lower part 3 includes the inner surface 7, outer surface 6 and internal threaded means 8. This part of the mandrel is held inside the tubing structure by means of positioning and attaching hermetic sealing means 2. The mandrel section 4 of the invention includes the housing member 11 which has a first end with the external threaded means 8*, that is matingly connected with the internal threaded means 8 of the mandrel part 3. The second end with the external threaded means 18 is connected with the threaded means 18* of mandrel part 5.

The inner surface with the internal threaded means 9 engage with the external threaded means 9* of the Laval nozzle 10 and engage the apertures 16, which are located along the plane 3—3, which is perpendicular to the longitudinal axis L of the tubing. Apertures 16 extend completely through the wall 11*a* of mandrel section 4. The Laval nozzle has the converging inlet section 12, the throat 13, the diverging outlet expanding section or diffuser 14 and the aperture or channels 15. Channels 15 are located along the plane 3—3 perpendicular to the longitudinal axis L of the tubing. Apertures 15 extend across the entire diameter of the nozzle 10 and into the throat 13 and matingly engage apertures 16 of the mandrel. Thus, nozzle throat 13 is in a direct continuous fluid flow channel of communication with annular space S through aperture channels 15 of the nozzle directly connected to aperture channels 16 of the mandrel.

The nozzle outer external threaded means 9* forms a joint with the threaded means 9. The nozzle is fixed inside the mandrel by the lock nut 20. The mandrel upper part or section 5 includes the inner surface 19, outer surface 17 and internal thread means 18* that is engaged with the external thread means 18 of mandrel part 4. The mandrel part 5 has this positioning and attaching means 30 for a standard placement and withdrawal tool means (not shown).

Figure 3:
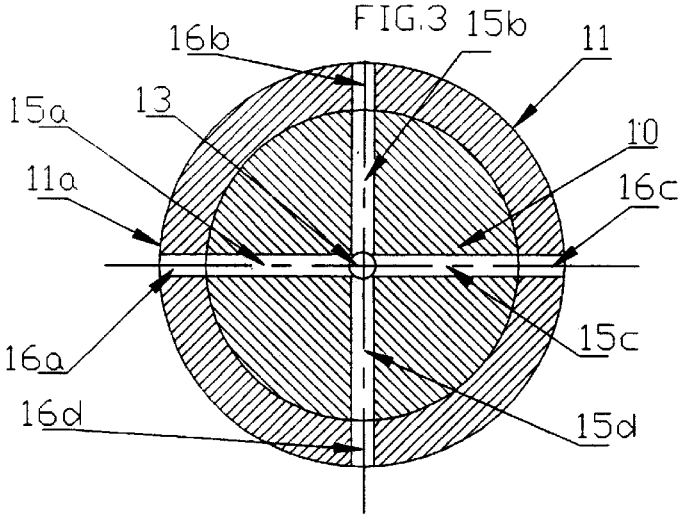
FIG. 3 is a sectional view of the nozzle throat taken along line 3—3 of FIG. 2.

FIG. 3 shows a cross section through the nozzle throat 13 which is perpendicular to the tubing longitudinal axis L. In this case apertures 15 and 16 are of the same diameter and are aligned.

Liquid H flows down along the wall of the well tube in the form of a liquid film within the annular space S. This liquid H can exist from the downstream location below nozzle throat 13 and above the hermetic sealing means 2 which blocks any further downward flow. Having these apertures 15 and 16 or channels extending from the annular space S to the throat 13 of the nozzle 10 enables the evacuation of this liquid H whether above or below the apertures 15 and 16 communicating with the throat 13 of the nozzle.

The liquid H can include liquid hydrocarbon (condensate) and liquid water. The amount of water can range between 0% and 60% by weight based upon the total weight of H.

Figure 4:
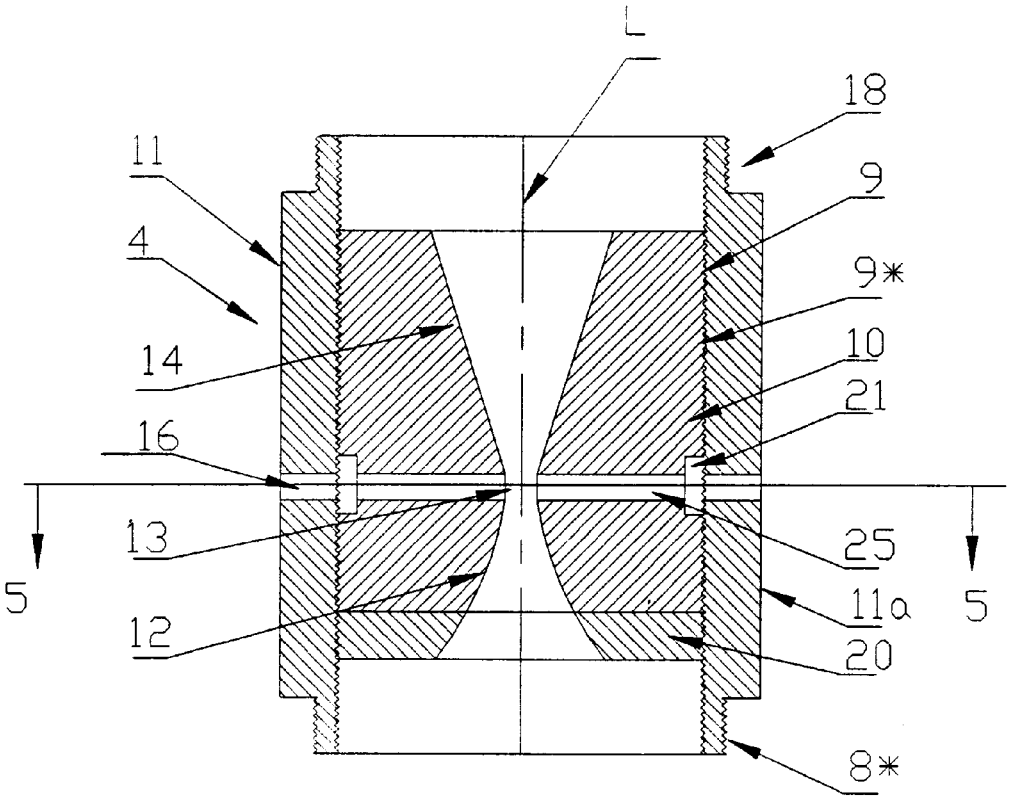
FIG. 4 is a sectional view of another embodiment of the nozzle of the invention.

FIG. 4 shows another embodiment of the mandrel middle part 4 which is similar to the mandrel middle part 4 shown in FIG. 2 and described above. The differences between FIG. 4 and FIG. 2 are based upon the additional feature which is the annular groove 21 of the nozzle 10. This groove 21 is located where the mandrel internal wall threaded means 9 engages with the external wall threaded means 9* of the Laval nozzle 10. In addition, annular groove 21 is positioned between apertures 16 extending completely through the wall 11*a* of the mandrel section 4 and the channels 25 extending across the nozzle 10. Nozzle channels 25 extend from the annular groove 21 across the nozzle into the nozzle throat 13. Thus, the nozzle throat 13 has a fluid flow communication channel through channels 25 to annular groove 21 and then to apertures 16. Apertures 16 communicate with space S. Annular groove 21 extends completely around the circumference of the nozzle 10. All of the other structural features are the same for FIGS. 2 and 4.

Figure 5:
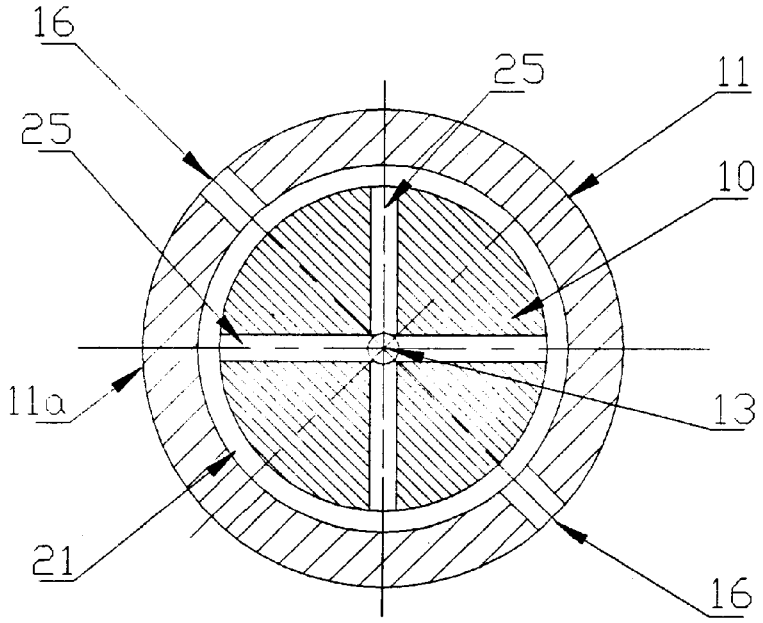
FIG. 5 is a sectional view of the nozzle throat taken along line 5—5 of FIG. 4.

FIG. 5 shows a cross section view of the nozzle throat 13 along line 5—5 of FIG. 4. Line 5—5 is perpendicular to longitudinal axis L through throat 13. FIG. 5 illustrates that the mandrel apertures 16 are not of the same diameter as the diameter of the channels 25. Here the diameter of the apertures 16 is greater than the diameter of the channels 25. FIG. 5 also shows that there are only two apertures 16, whereas FIG. 3 shows that there are four apertures 16*a*, 16*b*, 16*c* and 16*d*. Moreover, FIG. 5 shows that apertures 16 are not aligned with channels 25.

Figure 6:
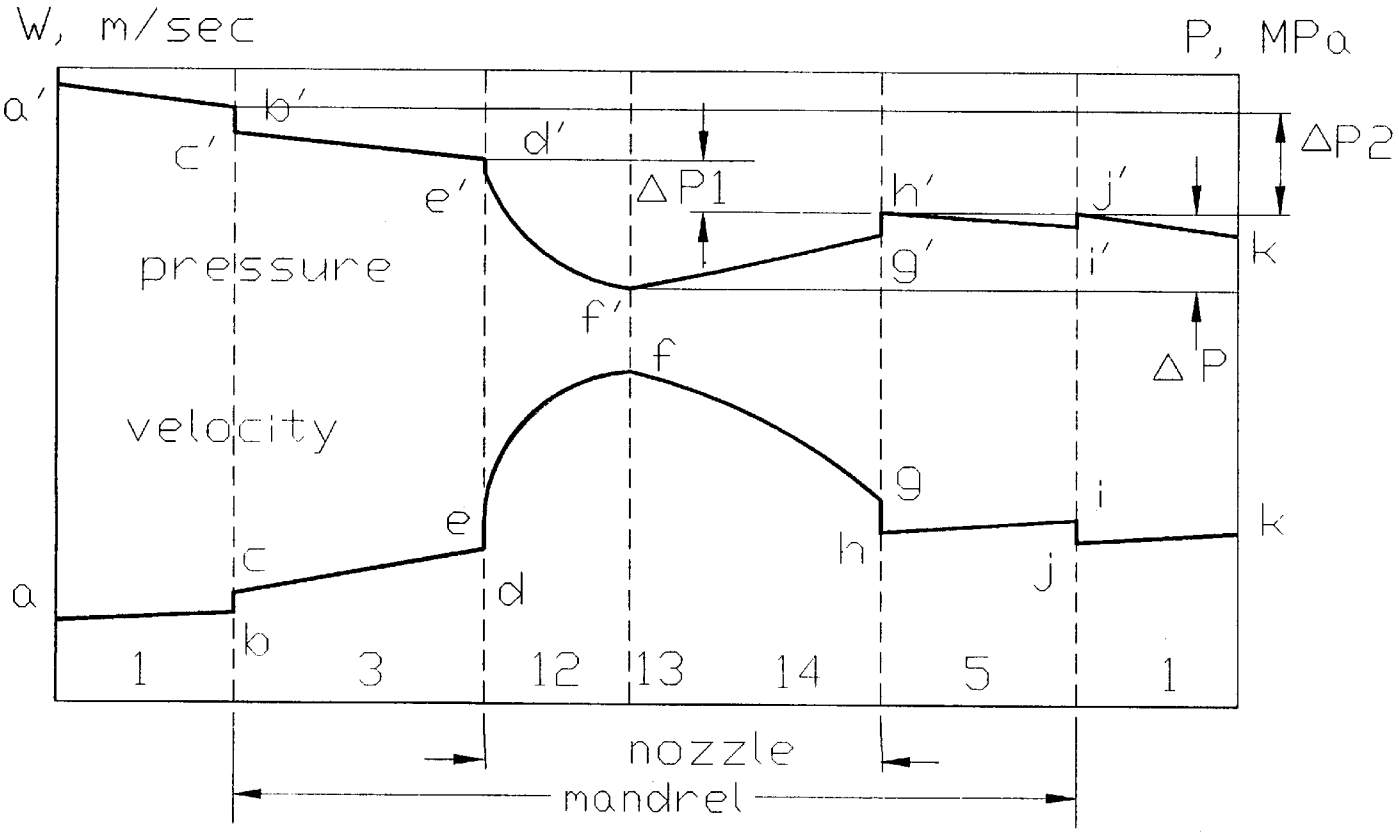
FIG. 6 is a diagram of pressure and flow velocity variation as a function of the tubing length containing the apparatus of the invention.

FIG. 6 shows how there is an alteration of the flow pressure and flow velocity through the tubing section and the invention installed there within. In the tubing section below the installed mandrel, the pressure declines (a'–b') due to the increasing of a static resistance. Thus, the fluid velocity slightly increases as a result of specific gas volume growth (a–b). There is the same condition in the mandrel sections 3 and 5, and tubing 1 below or above the mandrel (c–d, h–i, j–k—for velocity, and c'–d', h'–i', j'–k'—for pressure correspondingly). At the mandrel inlet section the fluid velocity sharply increases (b–c) because the inner diameter of the mandrel is less than tubing 1; and the pressure decreases in accordance with the Bernoulli law (b'–c').

There is the same condition at the nozzle inlet section (d–e—for increasing velocity; and d'–e'—for decreasing pressure). In the narrowing section of the nozzle 12 the flow velocity rapidly increases (e–f) and achieves its maximum in the throat 13 (f), and then decreases (f–g) in the diffuser 14. Accordingly to the Bernoulli law, pressure inside nozzle section 12 decreases (e'–f'), reaches its minimum in throat 13 and increases (f'–g') in the diffuser 14. In the narrowing nozzle passage 12 the static pressure is converted into kinetic energy by acceleration of the flow. Then the opposite occurs, in the expanding area 14 wherein the kinetic energy is converted into the static pressure by the slowing down of the flow velocity. At the nozzle outlet the flow velocity sharply decreases (g–h) and the pressure increases (g'–h') correspondingly because the flow cross section sharply expands.

The same condition occurs at the mandrel outlet section (i–j—for decreasing flow velocity, and i'–j'—for increasing pressure). ΔP2 is the difference between pressure in the inlet and outlet sections of the mandrel (b' and j'), and it is the total pressure drop dissipation in the device. ΔP2 includes dissipation in the inlet and outlet sections of the mandrel, friction dissipation and total dissipation in the nozzle (ΔP1). The difference between pressure in the mandrel outlet section 5 and in the nozzle throat 13 is ΔP and is the pressure which forces the downstream liquid from the tubing wall through the apertures 15 and 16 to flow to the nozzle throat 13.

The number and the dimension of these apertures are determined by the equation:

$$G = 0.61 * F * \sqrt{2 * \Delta P * \rho_c} * \sqrt[4]{d/1}$$

where:

| | |
|---|---|
| G | is the flow rate of downstream liquid in kg/sec; |
| ΔP | is the difference between pressure in the annular space among the tubing sections and the mandrel, and the pressure in a throat of the nozzle, in Pa; |
| $\rho_c$ | is the liquid density in kg/cubic meter; |
| d | is the diameter of the apertures in m; |
| l | is the length of the aperture in m; |
| F | = n * (p * d)$^2$/4 - total area of cross section of all apertures in square m; and |
| n | is the number of apertures. |

The installation of the invention into the well is by the known slickline operation. See for example Hisaw U.S. Pat. No. 5,562,161.

Other objects and features of the present invention will become apparent from the following Examples, which discloses an embodiment of the present invention. It should be understood, however, that the Examples are designed for the purpose of illustration only and not as a definition of the limits of the invention.

EXAMPLE 1

There is a gas-condensate well with the following parameters:

The gas phase is a mixture of gas components and the liquid phase is a mixture of liquid components.

| | |
|---|---|
| Gas Production | G = 350,000 scf/d = 10,000 cubic meters/d; |
| Tubing ID | D = 2" = 0.05 m; |
| Bottomhole pressure | P = 1400 psia = 10 MPa; |
| Atmosphere pressure | $P_o$ = 14 psia = .1 MPa |
| Surface tension | $\sigma = 30 \times 10^{-3}$ n/m; |
| Relative gas density | $\overline{\rho_g} = 0.7$; |
| Relative condensate density | $\overline{\rho_c} = 0.8$; |

The flow velocity at the bottomhole can be calculated as follows:

$$W=(4*G*Po)/(\pi*D^2*86400*P)$$

$$W=(4*10000*0.1)/(3.14*25*10^{-4}*86400*10)=0.59 \text{ meter/sec.}$$

The diameter of the liquid droplets is determined by the critical Weber criteria:

$$We\ cr=(\rho_g*W^2*d)/\tau=10;$$

Where:

$$\rho_g=\overline{\rho_g}*1.3*P/Po=91 \text{ kg/cubic meter.}$$

For the present Example:

$$D=10*\tau/(\rho_g*W^2)=10*30*10^{-3}/(91*0.59^2)=9*10^{-3}m=9 \text{ mm.}$$

If there is the flow velocity of 0.59 m/sec at the bottomhole, the large droplets of the 9 mm diameter can exist.

If a device is used having a nozzle throat with a 5 mm diameter (do), the velocity in the throat is:

$$Wo=(4*G*Po)/(\pi*do^2*86400*P)=59 \text{ m/sec.}$$

This velocity is one hundred times greater than the velocity would be without the device of the invention.

It means that the diameter of the droplets will be 10,000 times smaller than the diameter would be without the invention device: d=1 micron.

In the tubing the droplets will fall down if the gravitation ($F_{gr}$) exceeds the friction ($F_{ir}$) between droplets and gas flow.

The gravitation value is:

$$F_{gr}=(\pi*d^3*\rho_c*g)/6;\ g=9.81 \text{ m/sec}^2$$

Where:

$$\rho_c=\rho_c*1000.$$

The friction value is:

$$F_{fr}=\pi*d^2*C_D*\rho_g*W^2/8;$$

Where: $C_D$=0.45 is the droplet friction coefficient.

The maximum diameter (dm) of the droplet, when it does not fall down, can be found from the condition:

$$F_{gr}=F_{fr}\pi*dm^2*C_D*\rho_g*W^2/8=\pi*dm^3*\rho_c*g/6.$$

$$dm=(3*C_D*\rho_g*W^2)/(4*\rho_c*g)=(3*0.45*91*0.59)/(4*800*9.81)=3*10^{-3}m=3\text{mm.}$$

This calculation shows that the droplet diameter was three times greater than the value of $d_m$. Thus, the droplets will fall down. However, by using the device of the invention, the diameter of the droplets will be 3000 times smaller in comparison to the $d_m$ value; and the liquid droplets can be easily lifted up to the surface and out of the well.

EXAMPLE 2

The relationship between the number of apertures that are drilled through the nozzle throat, along with the diameter of each of these openings is given by correlation.

$$G = .61 * F * \sqrt{2 * \Delta P * \rho_c} * \sqrt[4]{d/1}$$

where F=n * ($\pi$ $d^2$/4) which equals the total area of cross section of all apertures.

The calculation procedure is:

1. Set d=$d_o$/4, where $d_o$ is the nozzle throat diameter.
2. Calculate the value of F from the above correlation.
3. Calculate the value of:

$$n = \frac{4F}{\Pi d^2}$$

and round to the nearest whole number.

Based upon the above equation, the number of apertures drilled through the nozzle throat and drilled through the mandrel, n ranges between 2 and 20 openings, preferably between 2 and 10 openings. FIG. 3 shows that there are 4 apertures 16*a*, 16*b*, 16*c*, and 16*d* drilled through the mandrel wall which matingly engage and are connected to 4 apertures 15*a*, 15*b*, 15*c*, and 15*d* respectively drilled through the nozzle 10. Thus, all four apertures are in fluid communication with throat 13.

While several embodiments of the present invention have been shown and described, it is to be understood that many changes and modifications may be made thereunto without departing from the spirit and scope of the invention as defined in the appended claims.

What is claimed is:

1. A method for increasing hydrocarbon production from a well, said well having a downhole pressure, having a reservoir, having an outlet, comprising the steps of:

installing an apparatus within a tubing section of the well above a hermetic sealing means within the tubing section;

creating a zone of decreased gaseous fluid pressure within said apparatus by increasing an upward velocity of a gaseous fluid upwardly flowing within said apparatus;

delivering a downstream hydrocarbon liquid from an outer wall of said tubing section to said upwardly flowing gaseous fluid within said apparatus;

dispersing said liquid into small liquid droplets within said apparatus within said zone of decreased gaseous fluid pressure by mixing together said liquid and said upwardly flowing gaseous fluid;

lifting said small liquid droplets upwardly to the outlet of said well;

whereby decreasing the downhole pressure of said well causes an increasing of an inflow of liquid from the reservoir of said well into and through said apparatus, and out of said well.

2. The method of claim 1, wherein creating said zone of decreased pressure within said apparatus comprises the acceleration of natural upward gaseous flow without any artificial gas injection being required.

3. An apparatus for increasing hydrocarbon production from a well and said well having a tubing section, comprising:

said well tubing section containing a mandrel;

said mandrel having a lower section, a middle section, and an upper section; said mandrel having an outer wall;

said lower section of said mandrel having hermetic sealing means installed inside said well tubing section;

said middle section of said mandrel having apertures drilled through a wall of said middle section;

a nozzle installed within said middle section with apertures drilled through a wall of said nozzle;

said apertures drilled through said mandrel and through said nozzle connecting together an annular space between said well tubing section and said mandrel outer wall, to a throat inside said nozzle; and said apertures creating a continuous fluid flow channel between the outer wall of the mandrel and the nozzle throat in the mandrel middle section; and said upper section of said mandrel having means for an attaching tool; said upper section having an outlet means through which the increasing hydrocarbon production can exit the well tubing section.

4. The apparatus of claim 3, wherein said nozzle is a Laval nozzle, which comprises a narrowing inlet section connected to a minimum cross section throat, and connected to an expanding outlet section diffuser with a minimum of dissipated energy.

5. The apparatus of claim 3, wherein said apertures of said mandrel and said nozzle are aligned in location and are in a plane perpendicular to a longitudinal axis of the tubing through said throat of said nozzle.

6. The apparatus of claim 3, wherein the mandrel has an internal wall and the nozzle has an external wall which engages said mandrel internal wall; and further comprising an annular groove extending around the nozzle and being located between said mandrel apertures and said nozzle apertures.

7. The apparatus of claim 6, wherein said annular groove is located where said internal wall engages said external wall.

8. The apparatus of claim 6, wherein said mandrel apertures and said nozzle apertures are not aligned with each other and are each connected to said annular groove.

9. The apparatus of claim 3, wherein a number and a dimension of said apertures of said mandrel and nozzle are defined as a minimum of cross section area for a full withdrawal of downstream liquid by an equation $$G = 0.61 * F * \sqrt{2 * \Delta P * \rho_c} * \sqrt[4]{d / 1}$$

where:

| | |
|---|---|
| G | is the flow rate of downstream liquid; |
| ΔP | is the difference between pressure in the annular space among the tubing sections and the mandrel, and the pressure in said throat of said nozzle; |
| $\rho_c$ | is the liquid density; |
| d | is the diameter of the apertures; |
| l | is the length of said aperture; |
| F | $= n * (p * d)^2/4$ is the total area of cross section of all apertures; and |
| n | is the number of apertures. |

* * * * *